US006269980B1

(12) United States Patent
Randall et al.

(10) Patent No.: US 6,269,980 B1
(45) Date of Patent: Aug. 7, 2001

(54) PORTABLE BEVERAGE DISPENSER

(76) Inventors: David M Randall; Donald M Dunkerly, both of P.O. Box 685, Arcadia, IN (US) 46030

( * ) Notice: Subject to any disclaimer, the term of this patent is extended or adjusted under 35 U.S.C. 154(b) by 0 days.

(21) Appl. No.: 09/436,172

(22) Filed: Nov. 8, 1999

(51) Int. Cl.[7] ..... B67D 5/60

(52) U.S. Cl. ..... 222/145.5; 222/156; 222/183; 222/185.1; 222/481.5

(58) Field of Search ..... 222/145.1, 145.5, 222/156, 183, 185.1, 481.5

(56) References Cited

U.S. PATENT DOCUMENTS

| | | | | |
|---|---|---|---|---|
| 3,170,601 | * | 2/1965 | Daley | 222/183 |
| 3,231,143 | * | 1/1966 | Cserny | 222/183 |
| 3,830,406 | * | 8/1974 | Robb | 222/185.1 |
| 4,260,074 | * | 4/1981 | Cerrato | 222/481.5 |
| 4,795,059 | * | 1/1989 | Sanders et al. | 222/145.1 |
| 5,118,009 | * | 6/1992 | Novitsky | 222/183 |
| 5,335,829 | | 8/1994 | Sovann | 222/183 |
| 5,366,115 | * | 11/1994 | Kersten et al. | 222/481.5 |
| 5,444,992 | | 8/1995 | Bell | 62/372 |
| 5,597,093 | | 1/1997 | Lee | 222/113 |
| 5,697,526 | | 12/1997 | Lee | 222/113 |
| 6,059,146 | * | 5/2000 | Meisner et al. | 222/145.1 |

FOREIGN PATENT DOCUMENTS

| | | | | |
|---|---|---|---|---|
| 999965 | * | 7/1965 | (GB) | 222/145.1 |

* cited by examiner

*Primary Examiner*—Joseph A. Kaufman
(74) *Attorney, Agent, or Firm*—Michael I Kroll

(57) ABSTRACT

The present invention discloses a beverage dispenser 10 having an upper housing 12 and a lower base 14 with a sealing gasket 40 for attaching 18 the housing 12 to the base 14. Both the housing 12 and base 14 are filled with a foam core 24 having multiple cavities 42 therein for receiving multiple dispensing bottles 16. Bottles 16 are connected by sockets 44 to a liquid reservoir 36 having an air vent 34 and a spigot 30. Embodiments are disclosed having a variable number of bottles 16.

6 Claims, 9 Drawing Sheets

PORTABLE BEVERAGE DISPENSER

BACKGROUND OF THE INVENTION

1. Field of the Invention

Figure 1:
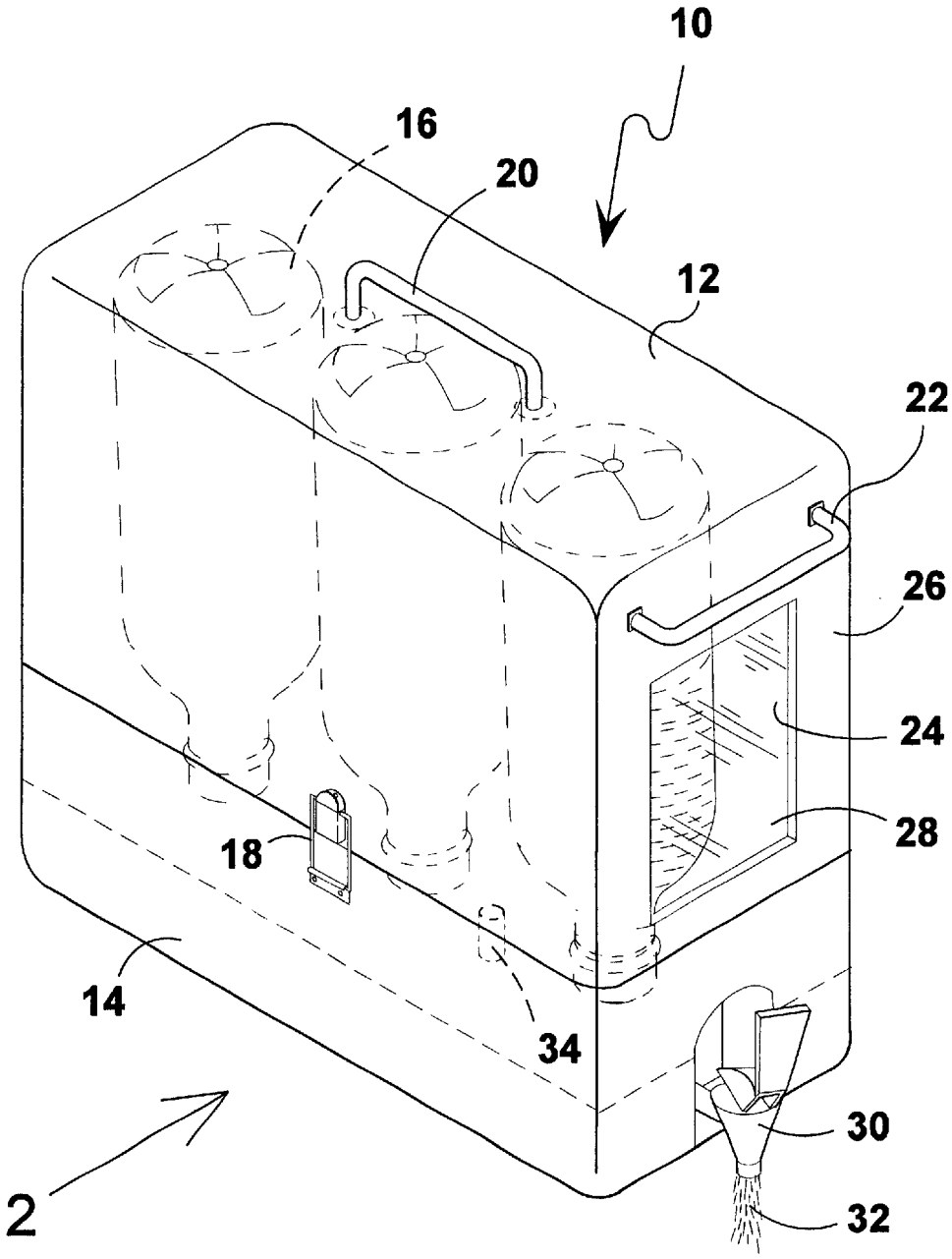

The present invention relates generally to beverage dispensers and, more specifically, to a portable beverage dispenser for a plurality of containerized liquids, for example 2 liter soda pop bottles, comprising a housing member and a sealably attachable base member.

The housing member has selectively engagable means for attaching or detaching the housing member from the base member. The housing member has a handle providing means for carrying the portable beverage dispenser. In addition said housing can have a solid foam interior conforming to slightly larger than bottle sizes for insulation and providing means additional housing structural integrity and/or containerized liquid support. Further the housing member can be made from solid color molded plastic with a clear window in the front, whereby the contents of the portable beverage dispenser can be easily viewed.

The base member has a selectively operable spigot connected to a reservoir having a plurality of sockets providing means for connecting beverage containers thereto. Also, the base member has an integral one-way pressure valve providing means for venting the beverage containers. In addition the base member can have an elastomeric gasket providing means for hermetically sealing the housing member to the base member.

2. Description of the Prior Art

There are other beverage dispenser devices designed for housing a plurality of bottles. Typical of these is U.S. Pat. No. 5,697,526 issued to Lee on Dec. 16, 1997.

Another patent was issued to Lee on Jan. 28, 1997 as U.S. Pat. No. 5,597,093. Yet another U.S. Pat. No. 5,335,829 was issued to Sovann on Aug. 9, 1994 and still yet another was issued on Aug. 29, 1995 to Bell as U.S. Pat. No. 5,444,992.

U.S. Pat. No. 5,697,526, Inventor: (Gary K. Lee, Issued: Dec. 16, 1997.

This includes a condiment, such as mustard, catsup, etc. dispensing unit. The condiment is in a container such as a bottle with a neck portion which is attached to a novel plastic dispenser cap. When the device is hanging upside down, the condiment in the container flows into the dispensing tip which has a valve mechanism such that no fluid flows out the end of the tip until pressure is applied by squeezing the plastic tip. A push rod with two spaced apart arms has a roller at the end of each arm. The rollers are a lesser distance apart than the diameter of the dispensing nipple. When the rod pushes the arm, the rollers roll against the dispensing nipple, squeezing and compressing it, and forcing its condiments out the lower end.

U.S. Pat. No. 5.335,829, Inventor: Nancy Sovann, Issued: Aug. 9, 1994.

A portable beverage dispenser for use with two liter beverage bottles. The dispenser supports bottles in an inverted position and is suited to be placed on a horizontal surface for outdoor use. A plurality of independent cap units are located on each bottle. A support cabinet is provided for housing the bottles during use.

U.S. Pat. No. 5,444,992, Inventor: Gary L. Bell, Issued: Aug. 29, 1995.

This invention disclosure pertains to a device which is used for cooling soda and food by means of a reusable two piece horizontally positioned iceblock pack which the parts thereof are molded to conform to the shape of a two liter soda bottle. The iceblock pack with bottle and a food holding tray are contained with a thickly insulated rectangular housing. A vented tap is screwed onto the bottle after being enclosed within the case to permit dispensing of the soda. The unit is supported into its tilted angled down position by means of an angular shaped leg apparatus which is also the carrying handle apparatus when rotated around to the top of the cooling unit and snapped onto the spring loaded buttons. The iceblock packs contained with the cooler are to be frozen within a freezing unit before usage.

While these beverage dispenser devices designed for housing a plurality of bottles may be suitable for the purposes for which they were designed, they would not be as suitable for the purposes of the present invention, as hereinafter described.

SUMMARY OF THE PRESENT INVENTION

The present invention discloses a beverage dispenser having an upper housing and a lower base with a sealing gasket therein between along with a means for attaching the housing to the base. Both the housing and base are filled with a foam core having multiple cavities therein for receiving multiple dispensing bottles. Bottles are connected by sockets to a liquid reservoir having an air vent means and a spigot outlet means. Embodiments are disclosed having a variable number of bottles.

A primary object of the present invention is to provide a portable beverage dispenser.

Another object of the present invention is to provide a portable beverage dispenser comprising a housing member and a base member.

Yet another object of the present invention is to provide a portable beverage dispenser comprising a housing member having a handle on top and front for ease of placement and removal from refrigerator and carrying said portable beverage dispenser.

Still yet another object of the present invention is to provide a portable beverage dispenser comprising a housing member having a solid foam interior conforming to slightly larger than size and shape of bottles enclosed providing support and structural integrity of said unit, also providing an insulating value. Also bottle alignment during assembly of said unit.

Another object of the present invention is to provide a portable beverage dispenser having a base member having a plurality of sockets communicating with a common reservoir.

Yet another object of the present invention is to provide a portable beverage dispenser having a base member having a plurality of sockets for attaching beverage containers thereto.

Still yet another object of the present invention is to provide a portable beverage dispenser having a base member having a one-way vent for venting the beverage containers.

Another object of the present invention is to provide a portable beverage dispenser having a base member having a spigot communicating with the reservoir.

Additional objects of the present invention will appear as the description proceeds.

The present invention overcomes the shortcomings of the prior art by providing a portable beverage dispenser for a plurality of containerized liquids. Said dispenser comprising a housing member and a sealably attachable base member.

The housing member having engagable means for attaching or detaching the housing member from the base member.

The housing member having a handle for carrying the portable beverage dispenser. Also provides a front handle for ease of placement and removal in and out of refrigerator. Also having a solid foam interior surrounding bottles for insulation and/or containerized liquid support and the housing can be fabricated from molded solid color plastic with a clear window in front permitting the contents of the portable beverage dispenser to be viewed.

The base member has a selectively operable spigot connected to a reservoir which is supplied by a plurality of beverage containers having socket connection means with said base member. Further said base member has a pressure valve for venting the beverage containers. In addition, the base member can have a gasket which seals the top and bottom together.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

FIG. 1 is a perspective view of the present invention in use. Shown is a portable beverage dispenser comprising a housing member and a base member being selectively sealably attached having a plurality of inverted bottles attached to said base member.

The housing member has selectively engagable means for attaching or detaching the housing member from the base member and a handle top and front providing means for carrying the portable beverage dispenser. Also shown is a foam core conforming to slightly larger than size and shape of bottles inside thus providing an insulating value and alignment of bottles also providing additional housing structural integrity and/or containerized liquid support. In addition said housing is fabricated from a solid color plastic molded shell with a clear window in front whereby the contents of the portable beverage dispenser can be easily viewed.

Figure 2:
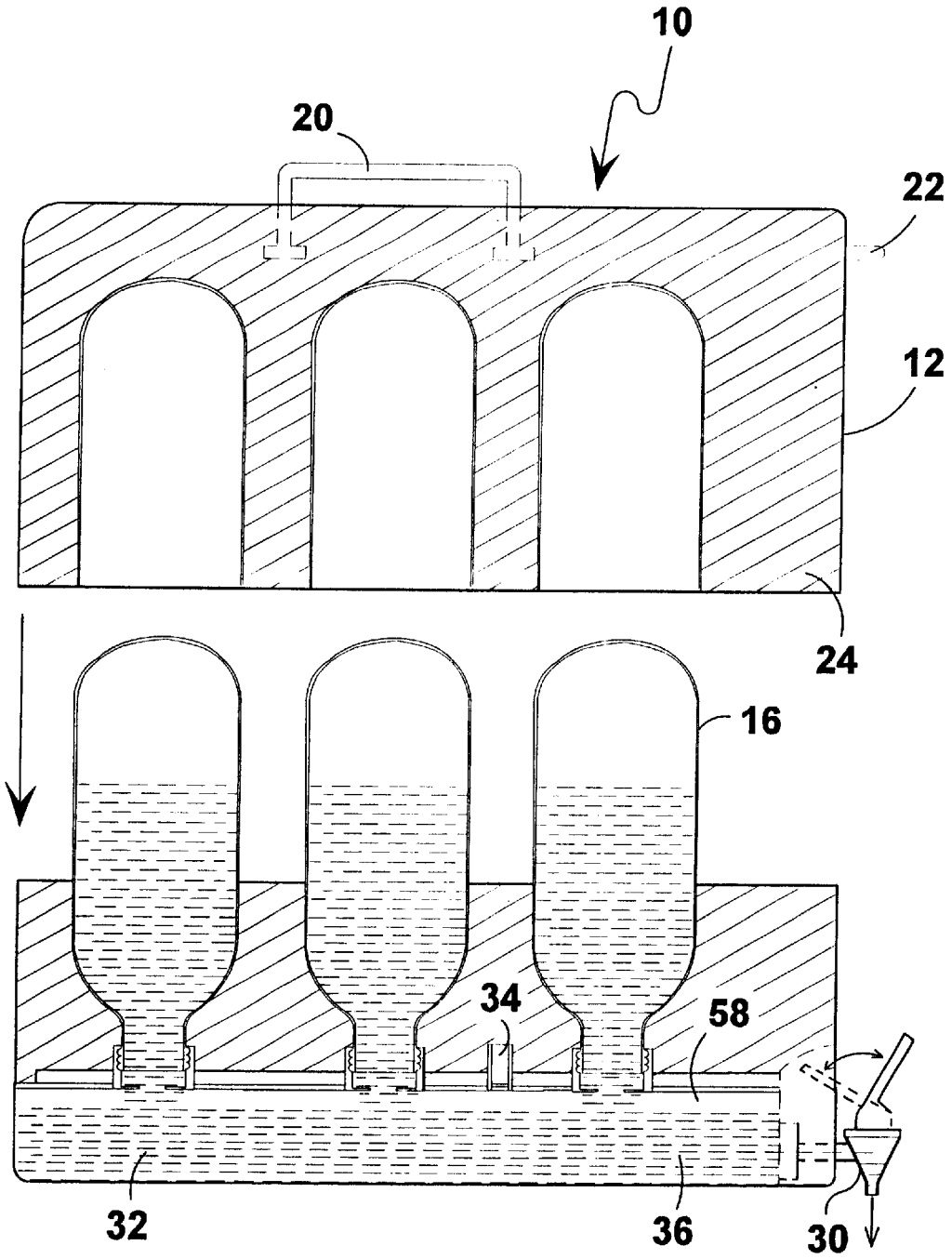

Also shown, is the base member having a spigot in the open position whereby the contents of the reservoir, not shown, can be retrieved. Also, the base member has an integral one-way pressure valve for venting the beverage containers as the liquid is depleted from the reservoir. In addition, the base member has an elastomeric gasket providing a seal with said housing;

FIG. 2 is an illustrative view of the operation of the present invention having containerized liquids attached thereto. The reservoir being hermetically sealed after the containerized liquid are attached, maintains a volume of compressed air. As the liquid is drawn off through the spigot the air pressure will decrease sufficiently causing the one-way valve to open allowing air to enter said reservoir. The air will gravitate into the containers causing the liquid in the reservoir to be continuously replenished until all liquid has been dispensed. Also, is a top section shown in an unassembled manner, note top and front handles, foam interior, and front clear viewing window.

Figure 3:
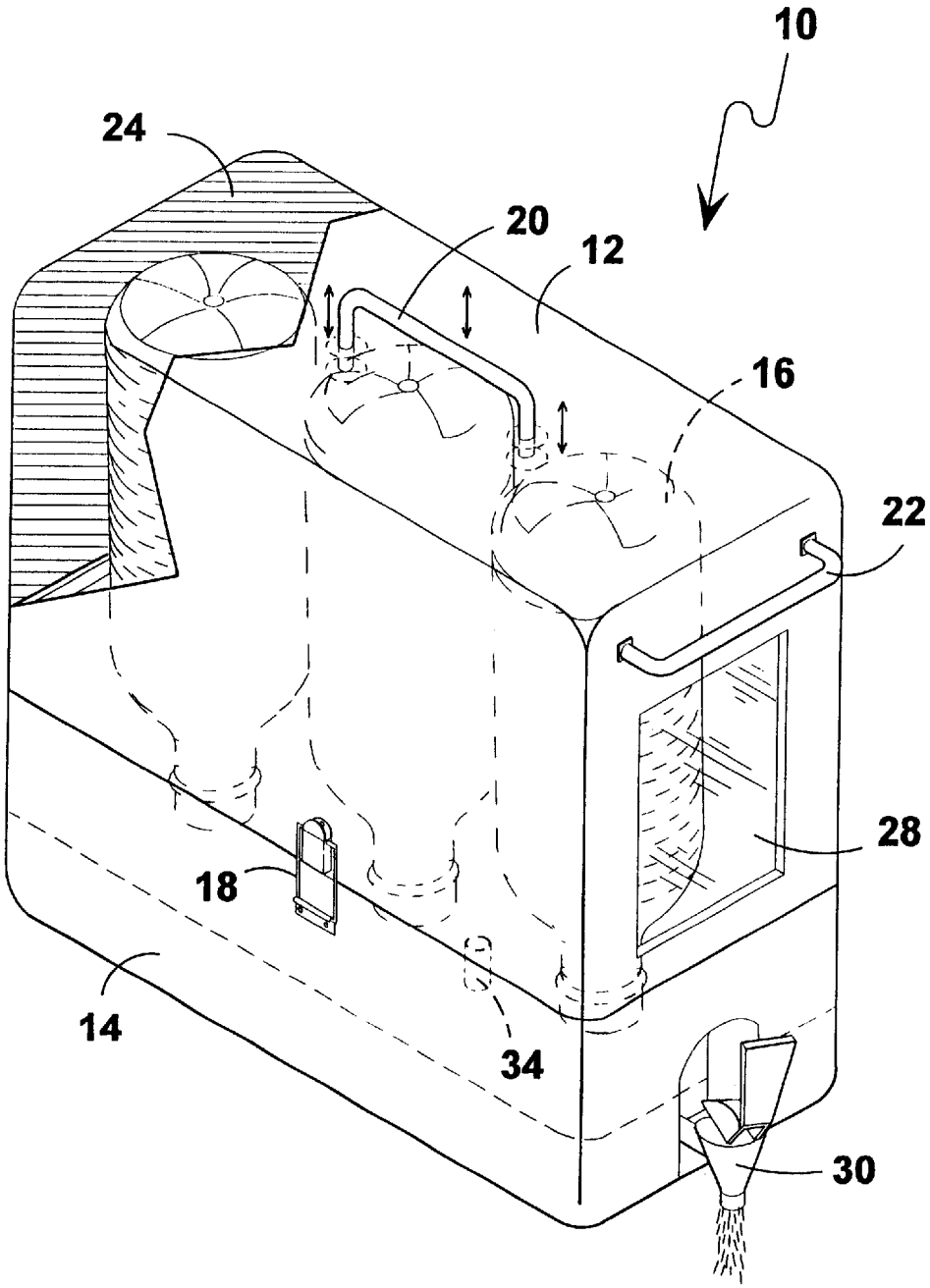

FIG. 3 is a perspective view of the present invention. Shown is a portable beverage dispenser comprising a housing member and a base member being selectively sealably attached having a plurality of inverted bottles, shown in outline, attached to said base member. The housing member has selectively engagable means for attaching or detaching the housing member from the base member. The housing member has a handle providing means for carrying the portable beverage dispenser. Also a handle in front for assistance of placement and removal in and out of refrigerator. In addition each housing half has a solid foam interior for insulating value and support and alignment of containerized liquid bottles. Further the housing can be made from a solid color molded plastic shell with a clear window in front for viewing contents.

Figure 4:
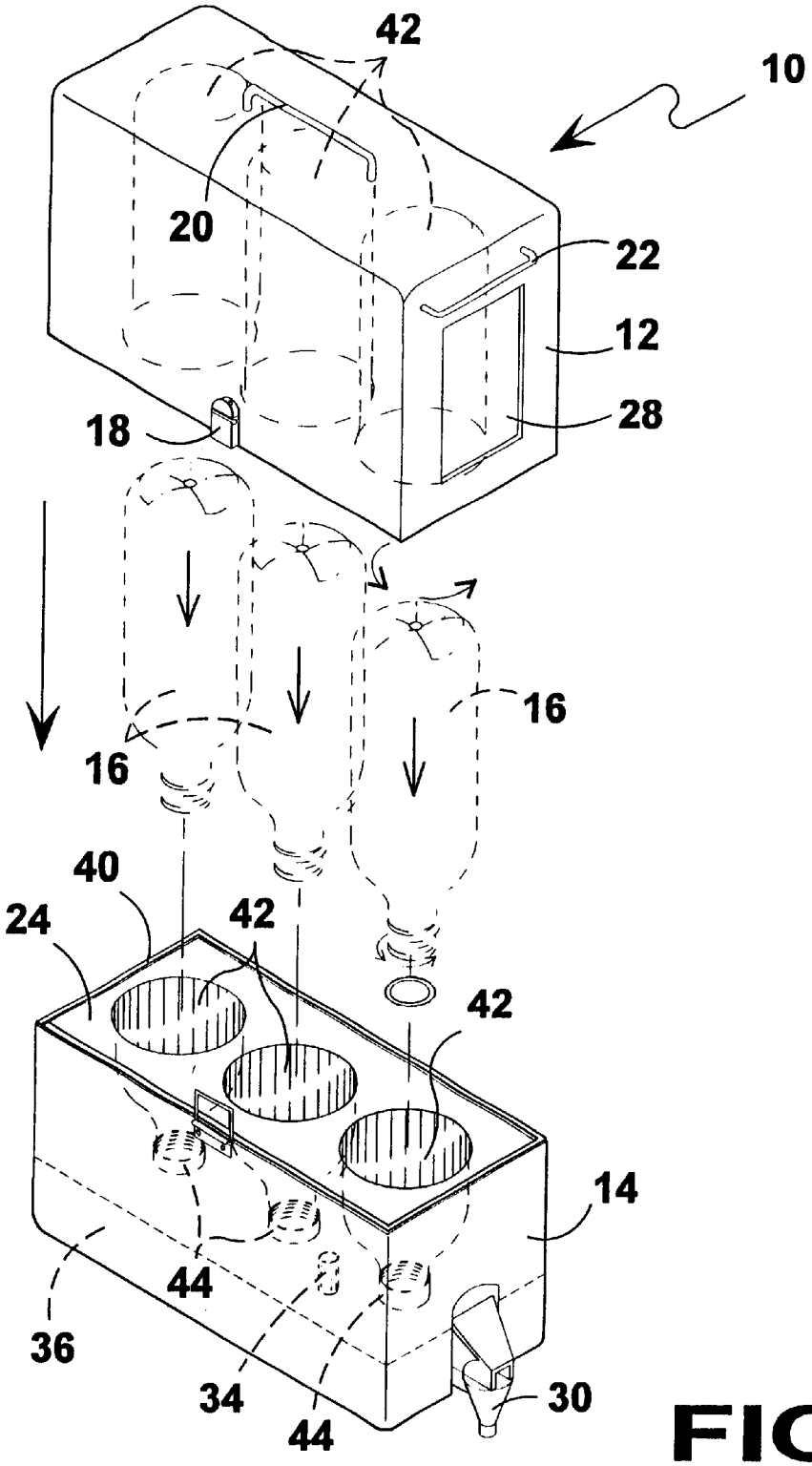

The base member has a selectively operable spigot connected to a reservoir having a plurality of sockets providing means for connecting beverage containers thereto. Also, the base member has an integral one-way pressure valve providing means for venting the beverage containers. In addition, the base member can have an elastomeric gasket providing means for hermetically sealing the housing member to the base member;

FIG. 4 is an exploded view of the present invention, shown is a portable beverage dispenser comprising a housing member, a gasket member and a base member.

The housing member has selectively engagable means for attaching or detaching the housing member from the base member. The housing member has a handle on top and front providing means for carrying the portable beverage dispenser. Also shown is a solid foam interior surrounding the containerized liquid bottles for insulation and additional structural integrity and/or containerized liquid support. The housing is made from a solid color molded plastic exterior with a window in front whereby the contents of the portable beverage dispenser can be easily viewed.

The base member has a spigot wherethrough the contents of the reservoir, not shown, can be retrieved. Also, the base member has a plurality of sockets for attaching containerized liquids, shown in outline, thereto, and an integral one-way pressure valve for venting the beverage containers as the liquid is depleted from the reservoir. In addition an elastomeric gasket provides a seal between said housing member and said base member.

Figure 5:
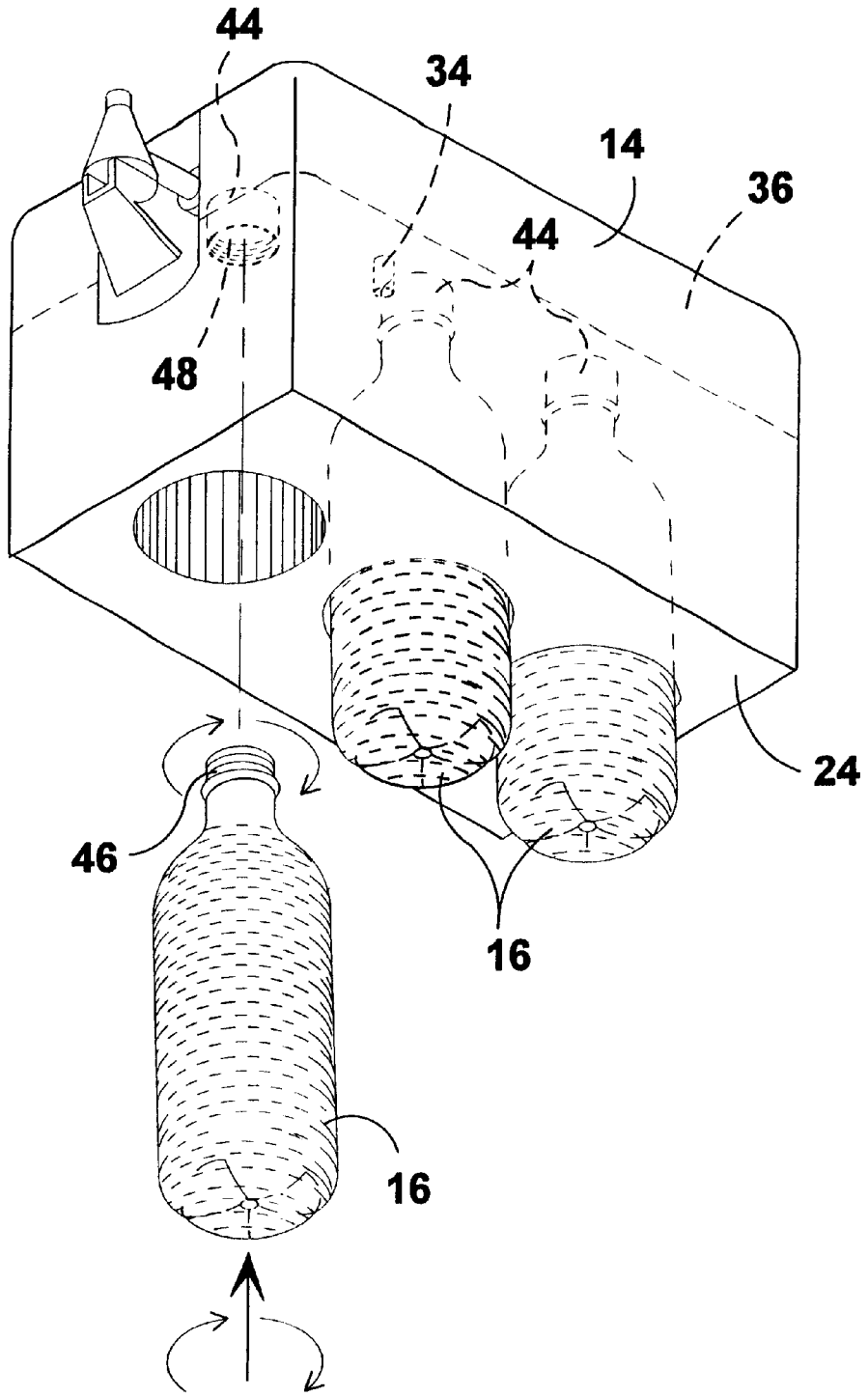

FIG. 5 is a perspective view showing the means for attaching the containerized liquids to the base member sockets. The reservoir of the base member has a quantity of air which will become trapped after inserting the last bottle. This trapped air will act in communication with the one-way valve to vent the liquid containers as the liquid is drawn off from the reservoir through the spigot.

Figure 6:
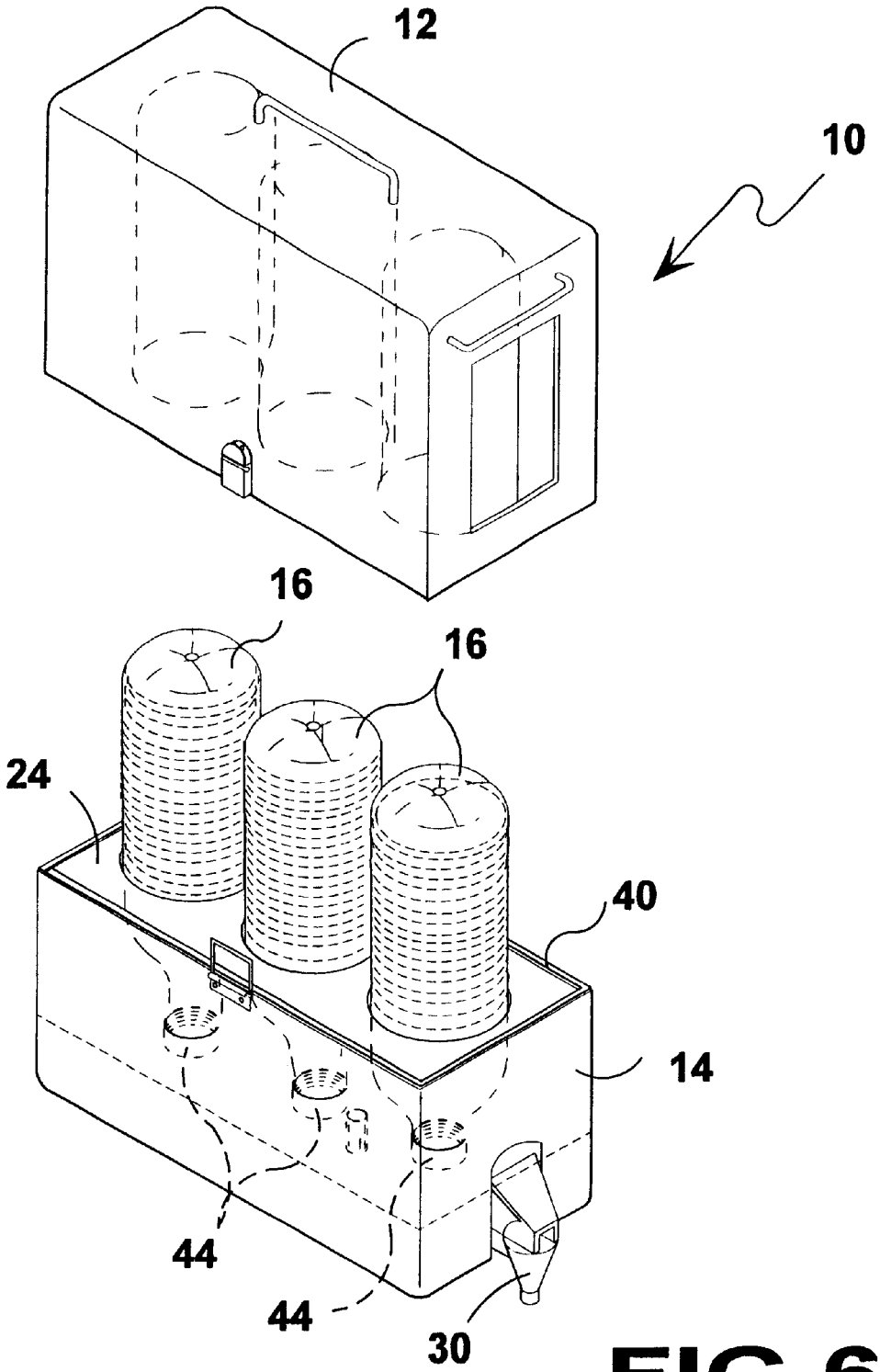

FIG. 6 is a perspective view continued from FIG. 5, showing the final step in producing the portable beverage dispenser. Where the base member having a plurality of containerized liquids fixedly attached to the base member sockets, is inverted and the housing member is placed over said containers and the sealing means is selectively engaged providing a watertight portable beverage container.

Figure 7:
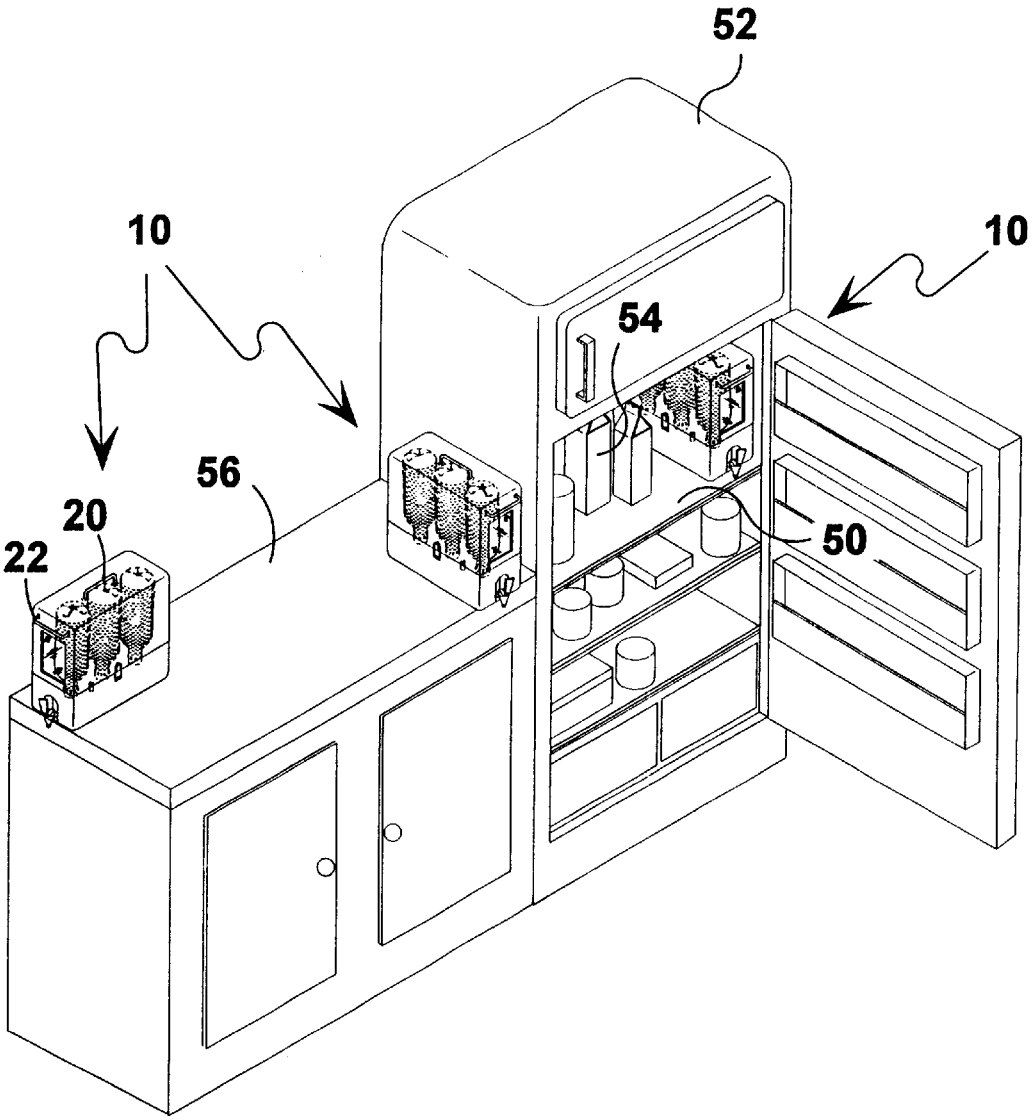

FIG. 7 is a perspective view indicating various useful placements of the present invention. Shown is the portable beverage dispenser positioned by means of the top and front handles on the top shelf of a refrigerator with other tall items. Said dispenser can be left in the refrigerator all the time or removed after chilling for placement on a counter top. In addition said beverage container can be carried on outings, such as ball games, social events and picnics.

Figure 8:
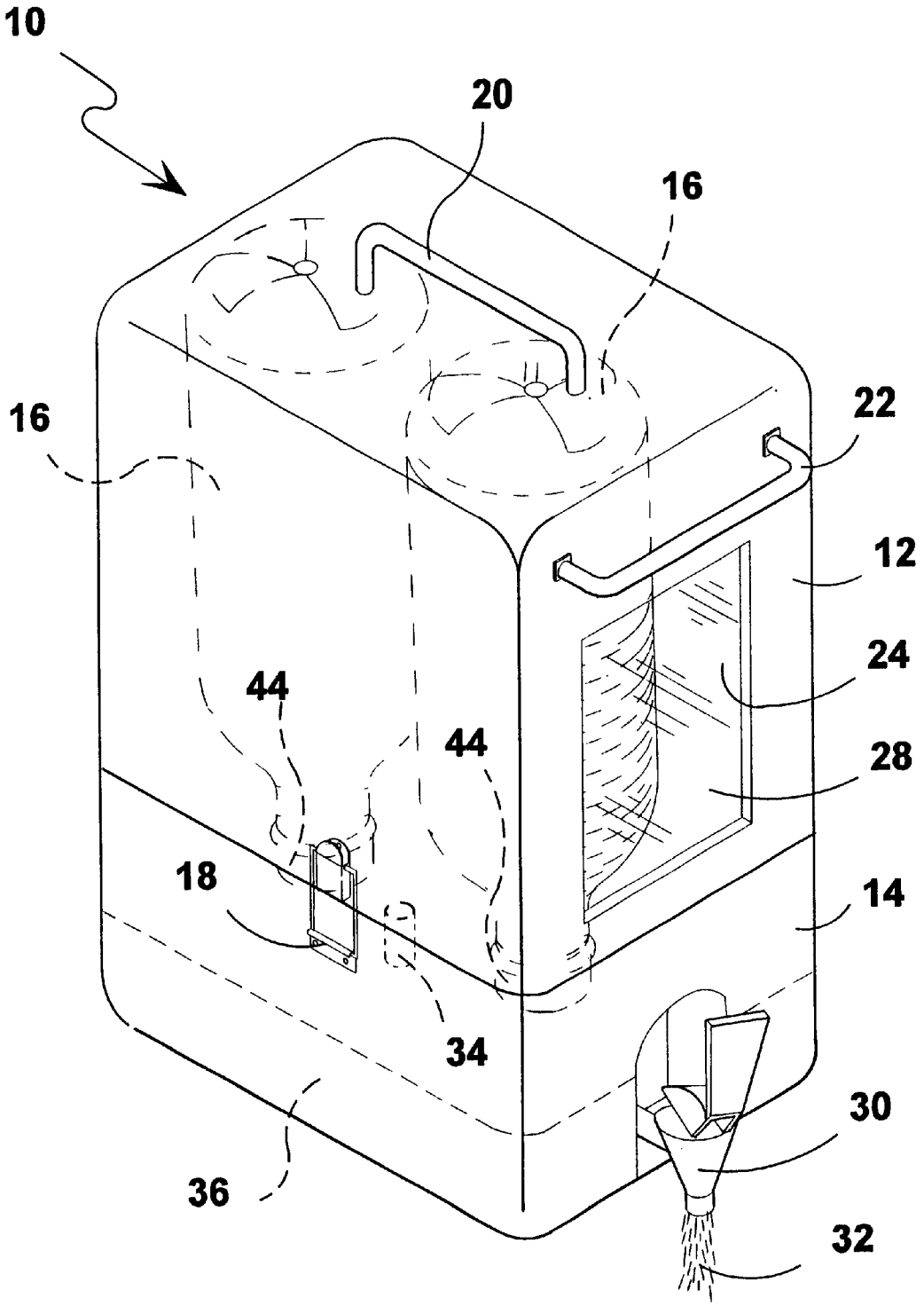

FIG. 8 is a perspective view of a variation of the base member having two sockets therein. Also shown is a portable beverage dispenser comprising a housing member and a sealably attachable base member having a plurality of bottles attached therein.

The housing member has selectively engagable means for attaching or detaching the housing member from the base member. The housing member has a handle top and front providing means for carrying the portable beverage dispenser. Also shown is a solid foam interior surrounding bottles to provide an insulating value and bottle alignment also providing means for additional housing structural integrity and/or containerized liquid support. The housing is made from a solid color molded plastic exterior with a clear window in front to view the contents of the portable beverage dispenser.

The base member has a spigot in the open position whereby the contents of the reservoir, not shown, can be retrieved. Also, the base member has an integral one-way pressure valve for venting the beverage containers as the liquid is depleted from the reservoir.

Figure 9:
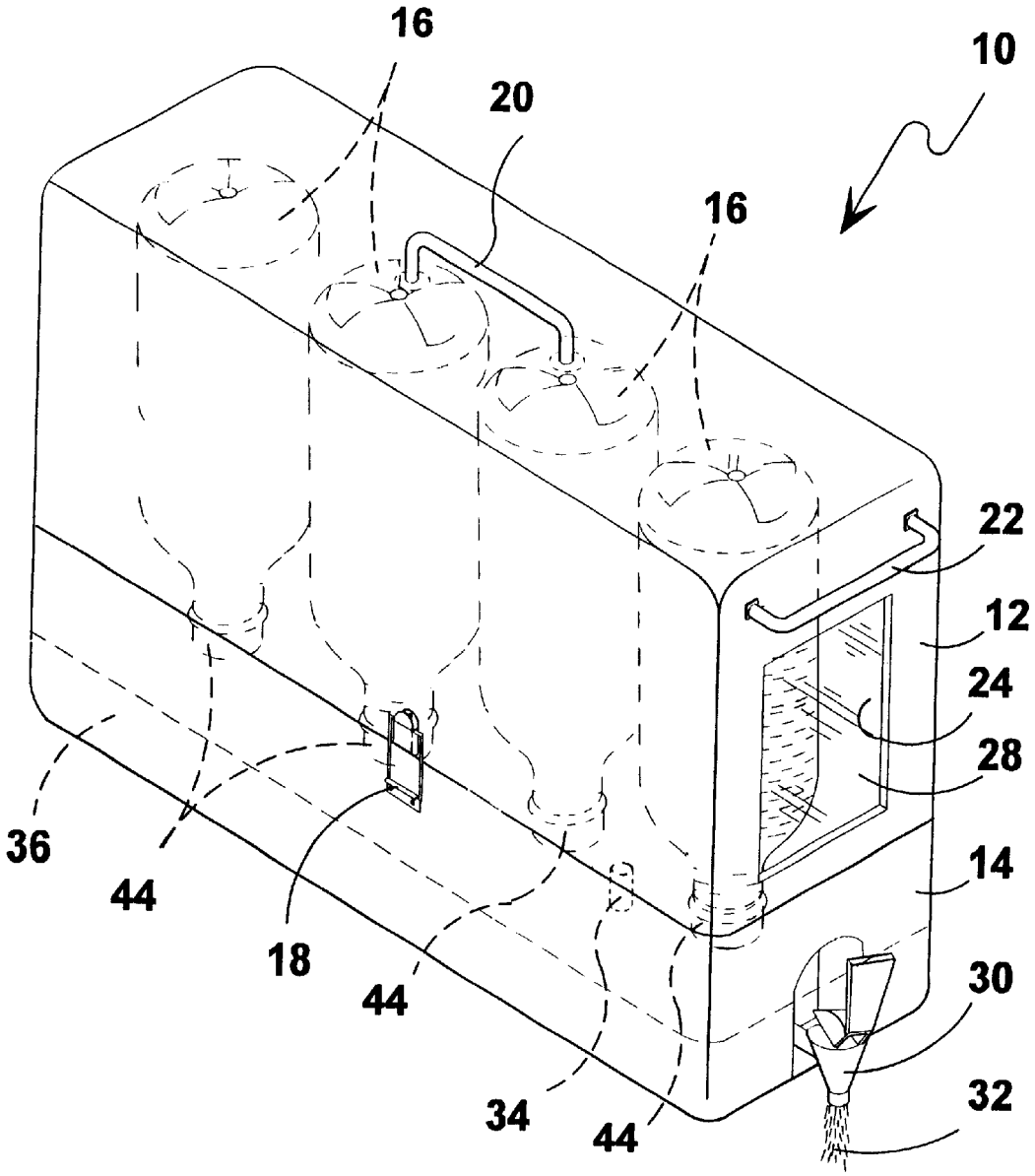

FIG. 9 is a perspective view of a variation of the base member having four sockets therein. Also shown is a portable beverage dispenser comprising a housing member and a sealably attachable base member having a plurality of bottles attached therein.

The housing member has selectively engagable means for attaching or detaching the housing member from the base member. The housing member has handles providing means for carrying the portable beverage dispenser. The housing is made from a solid foam interior surrounding bottles to provide insulating value and bottle alignment also providing means for additional housing structural integrity and/or containerized liquid support. Also having a window in front to view the contents.

The base member has a spigot in the open position whereby the contents of the reservoir, not shown, can be retrieved. Also, the base member has an integral one-way pressure valve for venting the beverage containers as the liquid is depleted from the reservoir.

List of Reference Numerals

With regard to reference numerals used, the following numbering is used throughout the drawings:

10 present invention
12 upper housing
14 base
16 bottles
18 latch means
20 top handle
24 front handle
24 foam core
26 shell
28 window
30 spigot
32 liquid
34 vent
36 reservoir
40 gasket
42 cavity
44 sockets
46 male threaded means
48 female threaded means
50 top shelf
52 refrigerator
54 tall items
56 counter top
58 air

DESCRIPTION OF THE PREFERRED EMBODIMENT(S)

In order that the invention may be more fully understood, it will now be described, by way of example, with reference to the accompanying drawings in which FIGS. 1 through 9 illustrate the present invention being a portable beverage dispenser.

Turning to FIG. 1, shown therein is a perspective view of the present invention 10 in use. Shown is a portable beverage dispenser 10 comprising an upper housing member 12 having a top, two sides, a front end, and a back end, along with a base member 14 having a bottom, two sides, a front end, and a back end, being selectively sealably attached having a plurality of inverted bottles 16 attached to said base member 14.

The housing member 12 has selectively engagable attaching means 18, being e.g., a latch of conventional design for attaching or detaching the housing member 12 from the base member 14 and a handle 20 on the top and front 22 providing means for carrying the portable beverage dispenser 10. Also shown is a foam core 24 substantially conforming to the shape, but slightly larger than the size, of multiple bottles 16 inside, thus providing an insulating value and alignment of bottles also providing additional housing structural integrity and/or containerized liquid support. In addition said housing 12 is fabricated from a solid color plastic molded shell 26 with a clear window 28 in front whereby the contents of the portable beverage dispenser can be easily viewed.

Also shown, is the base member 14 having a spigot 30 in the open position whereby the liquid contents 32 of the reservoir, not shown, can be retrieved. Also, the base member 14 has an integral one-way pressure valve 34 for venting the beverage containers as the liquid 32 is depleted from the reservoir. In addition, the base member 14 has an elastomeric gasket providing a seal with said housing.

Turning to FIG. 2, shown therein is an illustrative view of the operation of the present invention 10 having containerized liquids 16 attached thereto. The reservoir 36 fluidly communicating with containers 16 and being hermetically sealed after the containerized liquid 16 are attached, maintains a volume of compressed air 58. As the liquid 32 is drawn off from the reservoir 36 in fluid communication with and through the spigot 30 the air pressure will decrease sufficiently causing the one-way valve 34 to open allowing air to enter said reservoir 36. The air will gravitate into the containers 16 causing the liquid 32 in the reservoir 36 to be continuously replenished until all liquid 32 has been dispensed. Also, a top section 12 is shown in an unassembled manner, note top 20 and front 22 handles, and foam interior 24.

Turning to FIG. 3, shown therein is a perspective view of the present invention 10. Shown is a portable beverage dispenser 10 comprising an upper housing member 12 and a base member 14 being selectively sealably attached having a plurality of inverted bottles 16, shown in outline, attached to the base member 14.

The housing member 12 has selectively engagable means 18 for attaching or detaching the housing member 12 from the base member 14. The housing member 12 has a handle 20, providing means for carrying the portable beverage dispenser 10. Also a handle in front 22 for assistance of placement and removal in and out of a refrigerator. In addition, each housing half has a solid foam interior 24 for insulating value and support and alignment of containerized liquid bottles 16. Further the housing 12 can be made from a solid color molded plastic shell with a clear window 28 in front for viewing contents.

The base member 14 has a selectively operable spigot 30 connected to a reservoir having a plurality of sockets providing means for connecting beverage containers 16 thereto. Also, the base member 14 has an integral one-way pressure valve 34 providing means for venting the beverage containers 16. In addition, the base member 14 can have an elastomeric gasket providing means for hermetically sealing the housing member 12 to the base member 14.

Turning to FIG. 4, shown therein is an exploded view of the present invention 10. Shown is a portable beverage dispenser 10 comprising an upper housing member 12, a gasket member 40 and a base member 14.

The housing member 12 has selectively engagable means 18 for attaching or detaching the housing member 12 from the base member 14. The housing member 12 has a handle on top 20 and front 22 providing means for carrying the portable beverage dispenser. Also shown is a solid foam interior 24 having a cavity 42 therein surrounding the containerized liquid bottles 16 for insulation and additional structural integrity and/or containerized liquid support. The housing is made from a solid color molded plastic exterior with a window 28 in front whereby the contents of the portable beverage dispenser can be easily viewed.

The base member 14 has a spigot 30 wherethrough the contents of the reservoir (not shown) can be retrieved. Also, the base member 14 has a plurality of sockets 44 fluidly communicating between the reservoir and containers 16 and being for attaching containerized liquids 16, shown in outline, thereto, and an integral one-way pressure valve 34 for venting the beverage containers as the liquid is depleted from the reservoir 36. In addition an elastomeric gasket 40 provides a seal between the housing member 12 and the base member 14.

Turning to FIG. 5, shown therein is a perspective view showing the means for attaching the containerized liquids 16 to the base member sockets 44. The reservoir 36 of the base member 14 has a quantity of air which will become trapped after inserting the last bottle 16. This trapped air will act in communication with the one-way valve 34 to vent the liquid containers as the liquid is drawn off from the reservoir 36 through the spigot 30. Bottle 16 is threadably attached by means 46 being male means on its neck to female receiving means 48 on base member 14.

Turning to FIG. 6, shown therein is a perspective view continued from FIG. 5, showing the final step in producing the portable beverage dispenser 10. Where the base member 14 having a plurality of containerized liquids 16 fixedly attached to the base member sockets 44, is inverted and the housing member 12 is placed over the containers 16 and the sealing means is selectively engaged providing a watertight portable beverage container. Other features previously disclosed are also shown.

Turning to FIG. 7, shown therein is a perspective view indicating various useful placements of the present invention 10. Shown is the portable beverage dispenser 10 positioned by means of the top 20 and front handles 22 on the top shelf 50 of a refrigerator 52 with other tall items 54. Said dispenser 10 can be left in the refrigerator 52 all the time or removed after chilling for placement on a counter top 56. In addition said beverage container 10 can be carried on outings, such as ball games, social events and picnics.

Turning to FIG. 8, shown therein is a perspective view of a variation of the base member 14 having two sockets 44 therein. Also shown is a portable beverage dispenser 10 comprising a housing member 12 and a sealably attachable base member 14 having a plurality of bottles 16 attached therein.

The housing member 12 has selectively engagable means 18 for attaching or detaching the housing member 12 from the base member 14. The housing member 12 has a handle on top 20 and front 22 providing means for carrying the portable beverage dispenser 10. Also shown is a solid foam interior 24 surrounding bottles 16 to provide an insulating value and bottle alignment also providing means for additional housing structural integrity and/or containerized liquid support. The housing is made from a solid color molded plastic exterior with a clear window 28 in front to view the contents of the portable beverage dispenser 10.

The base member 14 has a spigot 30 in the open position whereby the liquid contents 32 of the reservoir 36 can be retrieved. Also, the base member 14 has an integral one-way pressure valve 34 for venting the beverage containers as the liquid is depleted from the reservoir 36.

Turning to FIG. 9, shown therein is a perspective view of a variation of the base member 14 having four sockets 44 therein. Also shown is a portable beverage dispenser 10 comprising a housing member 12 and a sealably attachable base member 14 having a plurality of bottles 16 attached therein.

The housing member 12 has selectively engagable means 18 for attaching or detaching the housing member 12 from the base member 14. The housing member 12 has handles 20, 22 providing means for carrying the portable beverage dispenser 10. The housing 12 is made from a solid foam interior 24 surrounding bottles 16 to provide insulating value and bottle alignment also providing means for additional housing structural integrity and/or containerized liquid support. It also has a window 28 in front to view the contents.

The base member 14 has a spigot 30 in the open position whereby the contents 32 of the reservoir 36 can be retrieved. Also, the base member 14 has an integral one-way pressure valve 34 for venting the beverage containers as the liquid is depleted from the reservoir.

What is claimed is:

1. An apparatus for a liquid beverage dispenser, comprising:

a) an upper housing, defined by a top, a pair of sides, a front end a and a back end;

b) a lower housing, defined by a bottom, a pair of sides, a front end and a back end;

c) a plurality of beverage containers circular in cross section for holding liquid, each beverage container having a neck with an opening threaded on the outside thereof and the neck of each said beverage container extending into said lower housing;

d) means for attaching said upper housing to said lower housing;

e) a foam core contained in said upper housing and said lower housing, said foam core having a plurality of cavities therein for receiving said plurality of beverage containers, each of said cavities in both said upper and lower housings being substantially the same size and shape of said beverage containers whereby said beverage containers are closely secured over the whole length of each of said containers within said cavities of said foam core for providing insulation of said beverage containers, said lower housing having internally threaded sockets to receive the threaded necks of said containers;

f) a reservoir disposed in said lower housing, said reservoir fluidly communicating with the open necks of said beverage containers and hermetically sealed when said beverage containers are attached;

g) means comprising a spigot at one end of said reservoir forming an outlet whereby liquid from all of said beverage containers can be removed from said reservoir;

h) a carrying handle both on said top of said upper housing and said front end of said upper housing thereby allowing said apparatus to be readily removed from a shelf and lifted for carrying; and i) means comprising an integral one-way valve communicating with said reservoir allowing said reservoir to be pressurized when said beverage containers are attached and venting said reservoir when liquid is drawn off through said spigot.

2. The apparatus of claim 1, further comprising said front end of said upper housing having a window therein for viewing the contents of said upper housing.

3. The apparatus of claim 1, wherein the number of beverage containers is two.

4. The apparatus of claim 1, wherein the number of beverage containers is three.

5. The apparatus of claim 1, wherein the number of beverage containers is four.

6. The apparatus of claim 1, said means for attaching further comprises a latch means whereby said upper housing is attached to said lower housing.

* * * * *